US008635737B2

(12) United States Patent
LeCompte et al.

(10) Patent No.: US 8,635,737 B2
(45) **Date of Patent: *Jan. 28, 2014**

(54) WRINGER

(75) Inventors: Phillip LeCompte, Lomita, CA (US); C. Travis Hunsucker, Lakewood, CA (US)

(73) Assignee: Micronova Manufacturing, Inc., Torrance, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/008,823

(22) Filed: Jan. 18, 2011

(65) Prior Publication Data

US 2011/0308032 A1 Dec. 22, 2011

Related U.S. Application Data

(63) Continuation of application No. 12/121,756, filed on May 15, 2008, now Pat. No. 7,870,636, which is a continuation of application No. 10/826,166, filed on Apr. 16, 2004, now Pat. No. 7,377,004.

(51) Int. Cl.
*A47L 13/14* (2006.01)

(52) U.S. Cl.
USPC ..... 15/261; 220/57.1; 220/572; 220/735; 248/110; 248/690

(58) Field of Classification Search
USPC ..... 15/260, 261, 248.2; 220/57.1, 572, 735; 248/110, 690
See application file for complete search history.

(56) References Cited

U.S. PATENT DOCUMENTS

| | | | | |
|---|---|---|---|---|
| 603,547 | A * | 5/1898 | Wolf | 15/260 |
| 2,290,217 | A * | 7/1942 | Trindl et al. | 15/261 |
| 4,047,261 | A | 9/1977 | Rones | |
| 4,525,892 | A | 7/1985 | Vayas et al. | |
| 4,704,763 | A | 11/1987 | Sacks et al. | |
| 4,716,619 | A | 1/1988 | Young | |
| 4,751,763 | A | 6/1988 | Rose et al. | |
| 4,908,904 | A | 3/1990 | Smith et al. | |
| 5,070,574 | A | 12/1991 | Delmerico et al. | |
| 5,274,877 | A | 1/1994 | Morad et al. | |
| 5,414,892 | A | 5/1995 | Clark, Jr. | |
| 5,615,446 | A | 4/1997 | Cetnarowski | |
| 6,279,195 | B1 | 8/2001 | Biggs | |

(Continued)

OTHER PUBLICATIONS

Unger Global, Bucket Sieve Product Detail for product No. QB060, Unger Global Website, date before Apr. 16, 2004, 2 pp., downloaded from Internet Oct. 4, 2006.

*Primary Examiner* — David Redding

(74) *Attorney, Agent, or Firm* — Henricks, Slavin & Holmes LLP

(57) ABSTRACT

A wringer has a support surface and a first wringer surface depending from the support surface to a second wringer surface having perforations and curving to a free edge substantially below the support surface. The second wringer surface may be curved in an approximately 180 degree arc. The first wringer surface may be flat and also perforated. The support surface may be formed as an inverted channel structure with a closed upper surface and an angled surface extending away from the first wringer surface. The angled surface may extend at an angle approximately 45 degrees. The wringer may be used with one or more buckets, where the wringer is supported from the rim of one bucket or from the adjacent rims of two buckets. A flat first wringer surface may be used to ring a flat mop, and the curved second wringer surface may be used to wring a round mop.

20 Claims, 6 Drawing Sheets

(56) References Cited

U.S. PATENT DOCUMENTS 6,327,740 B1 12/2001 Baltazar
6,560,815 B1 * 5/2003 Brennan et al. ..... 15/260
7,377,004 B2 * 5/2008 LeCompte et al. ..... 15/261
7,870,636 B2 * 1/2011 LeCompte et al. ..... 15/261

* cited by examiner

WRINGER

CROSS REFERENCE TO RELATED APPLICATIONS

This is a continuation of Ser. No. 12/121,756, filed May 15, 2008, now U.S. Pat. No. 7,870,636, which is a continuation of Ser. No. 10/826,166, filed Apr. 16, 2004, now U.S. Pat. No. 7,377,004.

BACKGROUND OF THE INVENTIONS

1. Field of the Inventions

The present inventions relate to wringers, including wringers that can be used to wring flat mops, round mops and mops having other configurations.

2. Related Art

Wringers for mops used in cleaning floors, walls, ceilings and other surfaces are often large, heavy and apply substantial pressure to mops to remove a substantial amount of cleaning fluid. Typical wringers apply mechanical pressure through opposing plates or surfaces while the user applies force to a crank, lever or other mechanism.

Mops used in medical and other facilities may be used to apply anti-bacterial, anti-germ or other disinfecting or cleaning fluids. During use, a desired amount of fluid should remain on or in the mop until the mop is applied to the surface. Typically, the mop is immersed in a quantity of clean fluid and then wrung out using a wringer to remove excess fluid. The fluid is then applied to the surface using the mop. However, if the wringer applies too much pressure, not enough fluid remains on the mop material to apply enough solution to the surface. As a result, the subject surfaces may not be cleaned according to required procedures.

Conventional wringers may not be suitable for some types of mops that are used in controlled environments, such as clean rooms, medical facilities and the like. For example, flat mops and round mops, particularly those using special materials, are not easily wrung using wringers that apply pressure to the mop with opposing plates or surfaces. An example of a flat mop is the SlimLine 2000, and one example of a round mop is the TMop, sold under those names by Micronova Manufacturing Inc.

SUMMARY OF THE INVENTIONS

One or more aspects of the present inventions can be used to provide a wringer that can more reliably wring mops, for example when it is desired to retain in or on the mop an amount of fluid to be applied to surfaces or other areas to be cleansed. One or more aspects of the present inventions can also be used to wring mops having specific shapes. Aspects of the present inventions may also be used to provide an improved assembly of a wringer and one or more buckets for use in cleansing surfaces and other areas.

In one example described herein, a wringer includes a support element, and a wringer surface having a first portion extending at a first angle and a second portion extending away from the first to terminate at a free end below the support element. The first and second portions of the wringer surface are preferably fixed to each other, and do not move relative to each other. The support element supports the wringer from a support surface, for example the rim of a bucket used to hold a fluid such as a cleaning, disinfecting or other appropriate fluid. The support element is preferably configured to extend over the rim of a single bucket or adjacent rims of two adjacent buckets.

In another example described herein, a wringer includes a support element and a perforated wringer surface depending from the support element. The wringer surface includes a first portion that extends at a first angle in a first direction from the support element to a lower wringer surface below the support element. A second portion of the wringer surface extends away from the first portion in a second direction different from the first direction and terminates at a free end below the support element. The first portion is preferably substantially flat and the second portion is preferably curved, for example away from the first portion in an arc so as to terminate at a free edge extending in a direction toward the support element. The second portion may curve through an arc more than 90 degrees and approximately through an angle of 180 degrees.

In a further example described herein, a wringer includes a support element and a perforated wringer surface depending from the support element. The support element includes an upper support wall and the wringer surface joins the upper support wall at an angle of approximately 135 degrees. The support element may also have an angled wall extending from the upper support wall away from the wringer surface. The angled wall may extend from the support element at an angle of approximately 45 degrees. The upper support wall extends longitudinally and is preferably free of openings so that fluid drains easily off of the upper support wall rather than through the upper support wall. The angled wall may terminate at an approximately vertical plate having a free edge. The free edge may be positioned at a line lower than the junction line between the support element and the wringer surface. The vertical plate helps to stabilize the wringer.

In an additional example described herein, a combination of a wringer and bucket is described where the wringer has a support element supported by a rim surface on the bucket. The support element includes a support wall and the wringer includes a first wringer surface supported by the support wall and a second wringer surface having perforations and supported by the first wringer surface. The second wringer surface is preferably curved and terminates in a free edge below the rim surface of the bucket. The support element may be configured to extend over adjacent rims of two buckets, and the wringer can extend into a waste bucket adjacent a clean fluid bucket. During use, a mop or other cleaning element is immersed in fluid in the clean fluid bucket and then pressed against either one or both of the first and second wringer surfaces. The wringer surfaces are stationary and fixed relative to each other, and the wringing action is achieved by pressing the cleaning element against the wringer surface. Preferably, perforations are formed in both of the first and second wringer surfaces, and they are configured in size, position and number to leave a desired amount of fluid on or in the mop or other cleaning element for application on the surface to be cleansed.

These and other examples are set forth more fully below in conjunction with drawings, a brief description of which follows.

DETAILED DESCRIPTION

The following specification taken in conjunction with the drawings sets forth the preferred embodiments of the present inventions in such a manner that any person skilled in the art can make and use the inventions. It should be understood that various modifications can be accomplished within the parameters of the present inventions.

It should be understood also that one or more aspects of the present inventions can be incorporated into a device or procedure to achieve one or more of the benefits of the present inventions without adopting all aspects or achieving all benefits of the inventions described herein. The examples of the inventions described herein are directed to apparatus and methods of using a wringer, but other apparatus can be used with the methods, and other methods can be used with the apparatus other than those described herein. For example, it is not necessary that a wringer having the configurations described herein be used with a particular type of mop or other cleaning element, or be used with a particular type of container or bucket, as the mops and buckets described herein are included as examples and to provide context to the construction and use of the wringer described. Additionally, configurations of a wringer other than those described herein can incorporate one or more aspects of the present inventions and/or achieve one or more of the benefits described herein.

Figure 1:
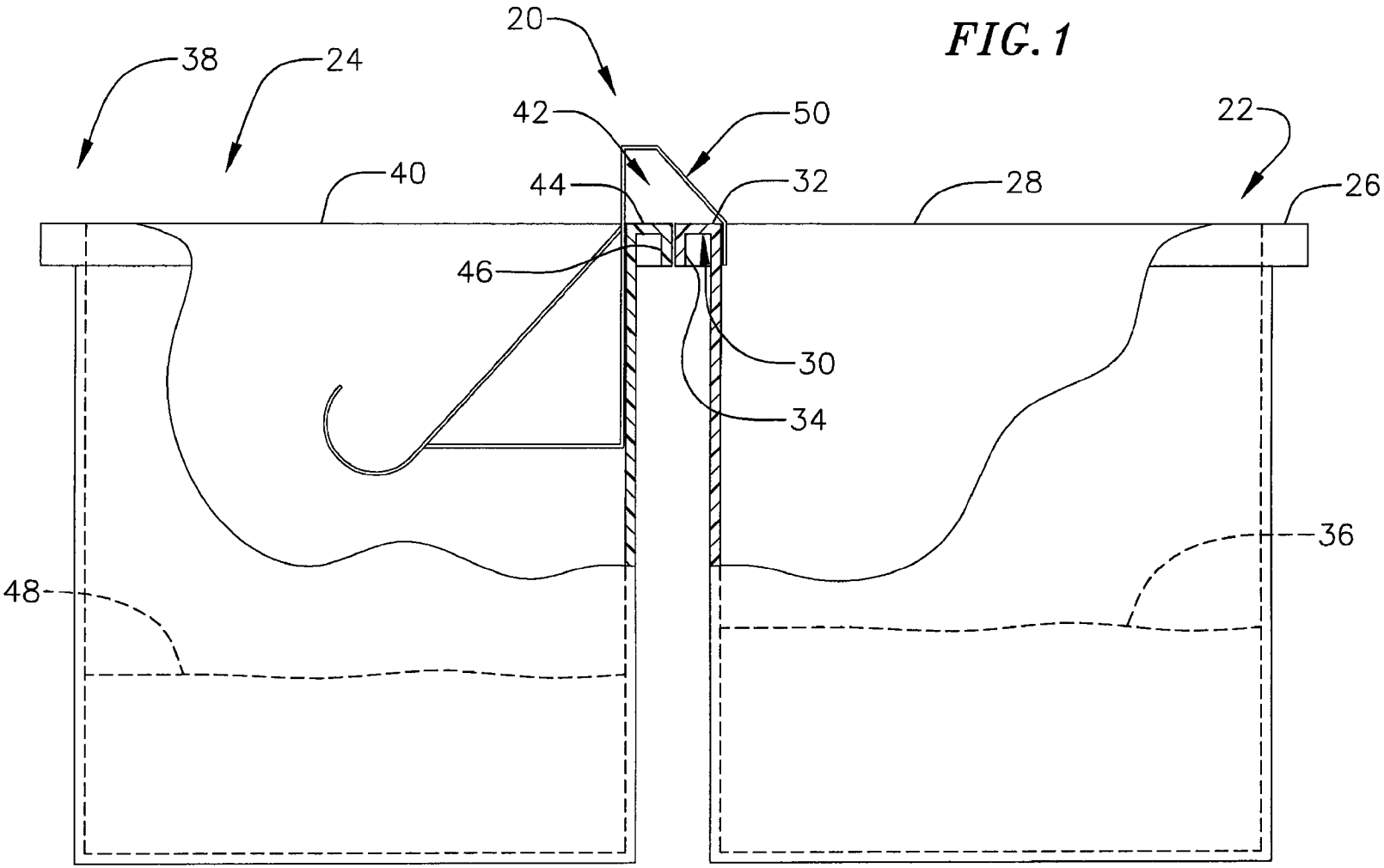
FIG. 1 is a schematic and side elevation and partial cutaway view of a pair of cleaning buckets and a wringer supported by adjacent rims of the buckets.
Figure 2:
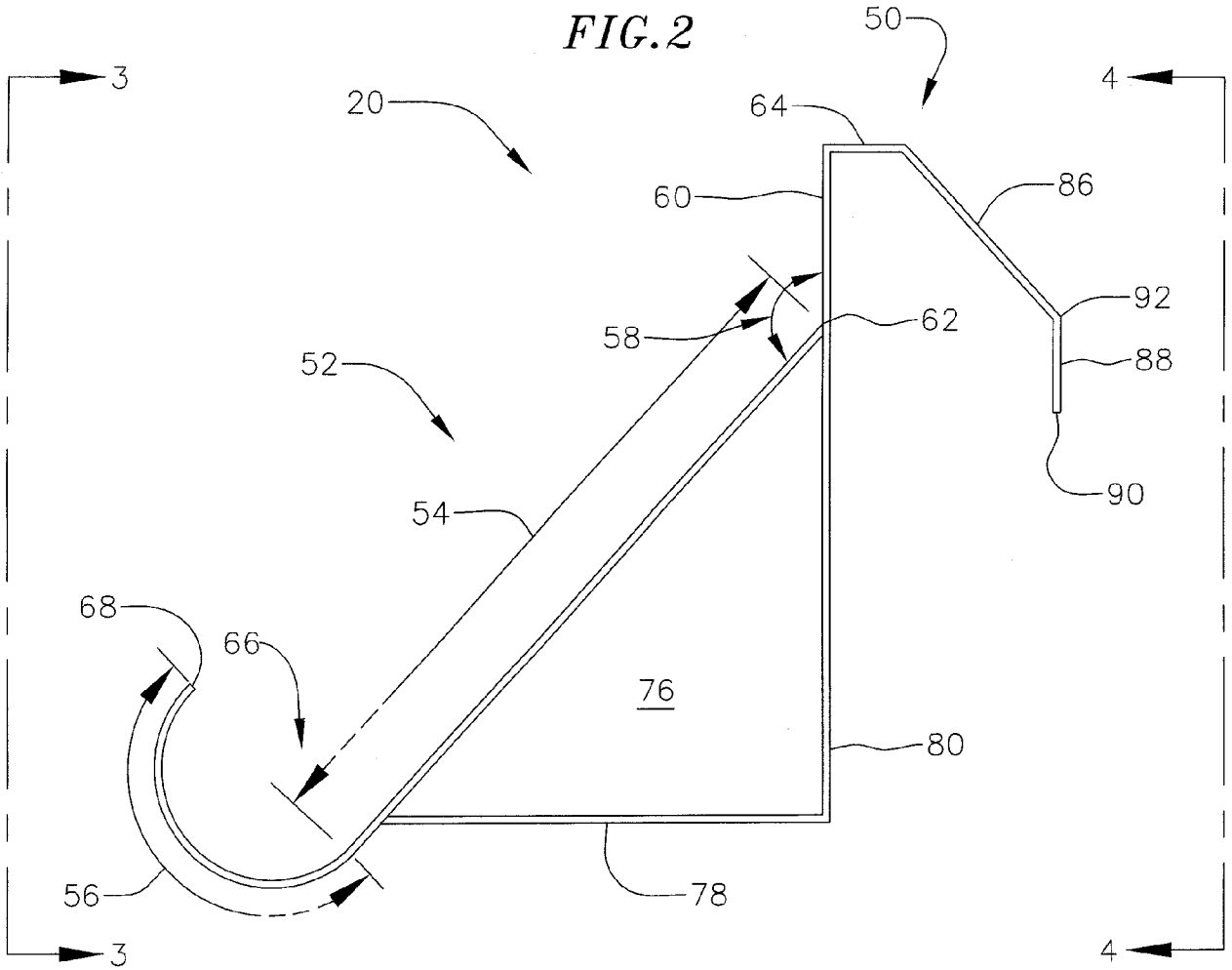
FIG. 2 is a schematic and end elevation view of one example of a wringer for use with one or more buckets such as those shown in FIG. 1.

A wringer 20 (FIGS. 1-6) will be described in the context of a double bucket system such as that shown in FIG. 1 having a first bucket 22 designated herein as the clean fluid bucket and a second bucket 24 designated herein as the waste fluid bucket. However, it should be understood that the wringer 20 can be used with a single bucket, more than two buckets, or with support structures other than fluid containers. The wringer 20 is described with the double bucket assembly to demonstrate one benefit of the wringer configuration described herein. In the examples, each of the first and second buckets will contain the desired fluid in the desired amounts, with the waste fluid bucket typically empty when the cleaning process is begun. The first bucket includes a front upper rim 26, a left side upper rim 28, and a rear upper rim 30. The right upper rim of the first bucket 22 is not shown as that portion of the wall has been cutaway in the view shown in FIG. 1. The rear upper rim 30 includes an upwardly facing surface 32 and an outwardly facing wall 34. In the present example, the first container 22 holds a fresh cleaning fluid 36, which may be any suitable fluid used in conventional procedures. It should be understated that terminology used for orientation, such as front, rear, side, left and right are used herein merely for ease of understanding and reference, and are not used as exclusive terms for the structures being described and illustrated.

The second bucket 24 includes a rear upper rim 38, a left side upper rim 40 and a front upper rim 42 adjacent the rear upper rim 30 of the first bucket 22. The right side upper rim of the second bucket 24 is not shown as part of the right side wall is cutaway to show the wringer 20. The front upper rim 42 includes an upwardly facing surface 44 and an outwardly facing wall 46. The second container holds contaminated cleaning fluid 48 wrung from a mop or other cleaning element. The first and second buckets 22 and 24 are substantially identical in the present example. The first and second buckets may be placed on a cart (not shown) having wheels, castors or other means for easily moving the buckets, and for supporting the buckets.

Considering the wringer 20 in more detail, the wringer includes a support element in the form of an inverted support channel 50 (FIGS. 2-6). The support element supports the wringer from a suitable support surface, such as the adjacent upper rims 30 and 42 of the double bucket assembly, a rim of a single bucket or other suitable support surface. The wringer also includes a wringer surface 52. The wringer surface can take a number of configurations, and preferably serves as a base, back stop or other contact surface against which a mop or other cleaning element is applied, such as by pressure, rolling, rubbing or other suitable application, for removing fluid from the mop or other cleaning element while preferably leaving sufficient fluid on the mop or other cleaning element to enable the fluid to be applied to the floor, wall, ceiling or other surface or area to be cleansed. While a number of cleaning elements can be used with the wringer described herein, examples provided will discuss mops. Therefore, it should be understood that other products and devices can be used with the wringer described herein.

Figure 3:
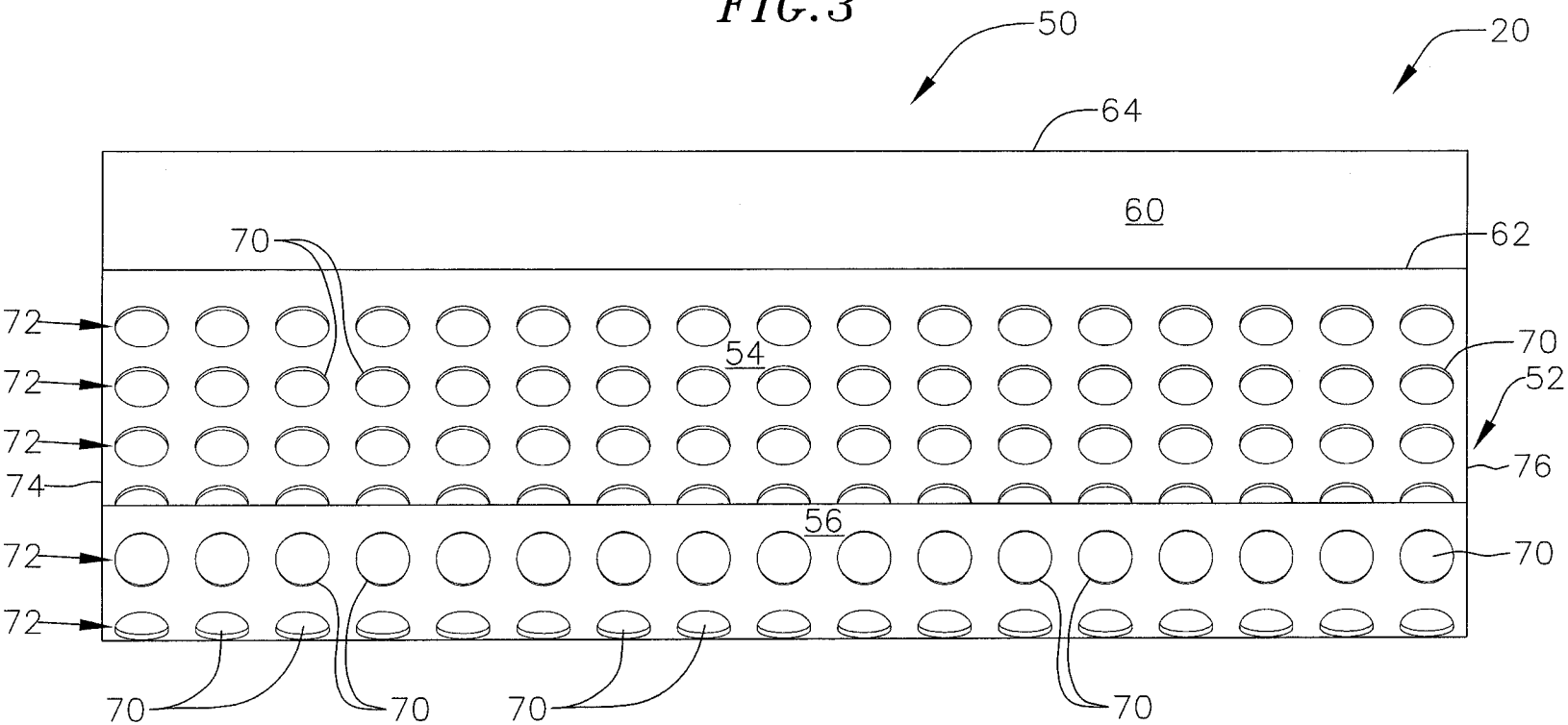
FIG. 3 is a front elevation view of the wringer of FIG. 2.
Figure 4:
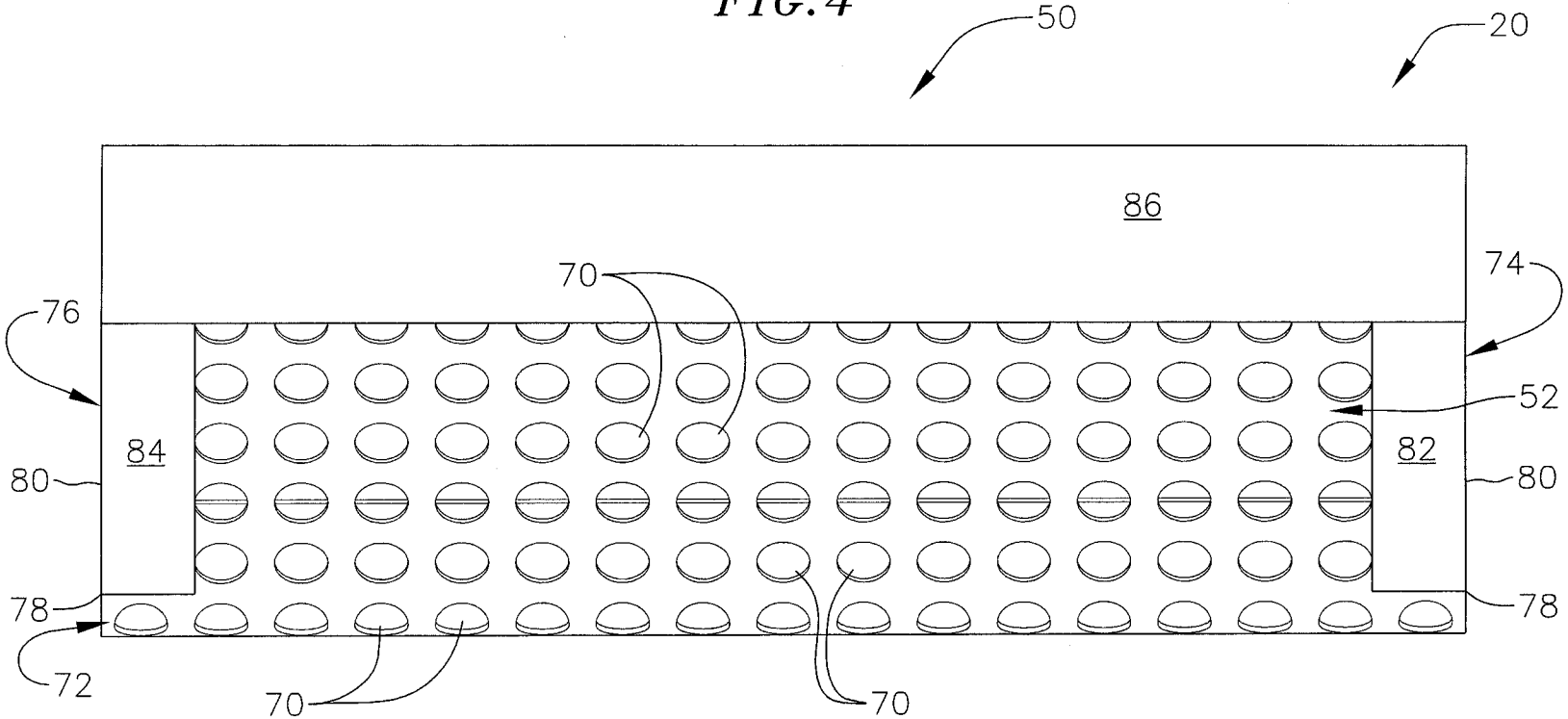
FIG. 4 is a rear elevation view of the wringer of FIG. 2.

In the present example, the wringer surface 52 includes a first portion in the form of a perforated base plate 54 that extends longitudinally from left to right, as shown in FIGS. 3 and 4, to provide a surface sufficiently wide to allow complete contact with the base plate 54 by the entire width of the mop. The width can be selected so as to accommodate the bucket size as well as the size of the mop head. Aside from the side plates and the ear flanges on the rear portion of the wringer described below, the profile of the support element 50 and the wringer surface 52 is substantially the same over the entire width of the wringer. The wringer surface 52 also includes a second portion in the form of a perforated channel plate 56, which also extends longitudinally from left to right.

In the illustrated example, the base plate 54 of the wringer surface joins the support element 50 forming an angle 58 of approximately 135 degrees, so that the base plate 54 depends from and is supported by a substantially vertical wall 60 at a line 62 (FIG. 3). The line 62 is at a first level below the top or upper surface 64 of the support element 50. The base plate 54 extends downwardly in a first direction from the vertical wall 60 to a lower portion of the base plate, designated generally by the dashed lines at 66, which lower portion of the base plate is below the support element 50. Preferably, the lower portion 66 of the base plate 54 is substantially below the support element 50.

The lower portion 66 of the base plate 54 transitions to the perforated channel 56. The perforated channel is preferably integral with the base plate 54 and curves so as to follow an arc of greater than about 90 degrees and preferably approximately 180 degrees to a free edge or end 68. The perforated channel 56 extends away from the base plate 54 and curves upward and back generally in the direction of the support element 50, but the free edge 68 does not necessarily point precisely at the support element 50. The perforated channel 56 is preferably formed to accommodate wringing of a round mop, such as that shown in FIG. 5. The free edge 68 is also preferably significantly below the support element 50. As can be seen in the side view of FIG. 2, the wringer surface is asymmetrical about a vertical plane extending into the paper of FIG. 2.

Both the base plate 54 and the channel 56 include elements for removing fluid from the mop. In the examples described herein, the fluid removing elements take the form of perforations 70, preferably distributed evenly over the base plate 54 and the channel 56. The perforations in the example are arranged in rows 72, and they are preferably a half-inch in diameter with 22 perforations in each row, with approximately half inch to one inch in center-to-center spacing between each perforation, and preferably about three-quarter inch center-to-center. The center-to-center spacing is preferably the same horizontally and vertically. It is believed that about 50% open space to about 50% solid material space is suitable for a desired amount of wringing. In the example shown, there are five rows 72 of perforations in the base plate 54, and three rows 72 of perforations in the perforated channel 56. The perforations at the end of each row are preferably approximately ½ inch from the adjacent edge of the wringer. The number of perforations and the number of rows 72 may be determined by the overall dimensions of the wringer, the width of the example described herein is about 16¾ inch from left side to right side.

The wringer surface 52 is supported and held away from the bucket wall by left and right side plates 74 and 76, respectively (FIGS. 2-4), extending rearward from the respective left and right edges of the base plate 54. Each side plate preferably includes a lower, substantially horizontally extending wall 78 and a rear, substantially vertically extending wall 80. The horizontally extending wall 78 meets the base plate 54 in the general location of the transition between the base plate 54 and the channel 56. The vertical wall 80 joins the base plate 54 at the horizontal line 62, where the base plate 54 is supported by the vertical wall 60. The vertical wall 80 is preferably aligned with the vertical wall 60. As shown in FIG. 4, respective left and right ear flanges 82 and 84 extend inwardly from their respective side plates 74 and 76. The ear flanges 82 and 84 help to support the wringer against the support structures, for example the side walls of the respective bucket. The ear flanges 82 and 84 are preferably formed by bending the flanges inward to be perpendicular to the respective side plates of which they are a part, and they may be rectangular or they may have their inner corners angled or clipped (not shown).

The support element 50 extends longitudinally the entire width of the wringer. The support element is formed from the vertical wall 60 and the upper wall 64 perpendicular to the vertical wall 60. The wringing surface is supported by the support element through the vertical wall 60. The support element also includes an angled wall 86 (FIGS. 2 and 4) extending downwardly and away from the wringer surface at an angle of approximately 45 degrees from the horizontal upper surface 64 or from a vertical line. The angled wall 86 terminates in an outer vertical wall 88 extending downwardly to a lower free edge 90. The junction 92 between the angled surface 86 and the vertical wall 88 occurs along a line at a vertical distance below the upper surface 64 approximately the same as the vertical distance below the upper surface 64 that the vertical wall 60 joins the base plate 54 at the line 62. The free edge 90 terminates a distance below the junction 62 between the vertical wall 60 and the base plate 54.

The support element 50 in the present example fauns an inverted channel with the walls 60, 64, 86 and 88 opening downwardly. The support element 50 extends over and is supported by the upper rim of one or two buckets. With a single bucket, the depth of the upper wall 64 from front to back is approximately the same as or greater than the width of the upper surface of the bucket so that the rim surface contacts the underside of the upper wall 64. With a double bucket and adjacent upper rim surfaces supporting the support element 50, the inverted channel of the support element 50 contacts and pushes the adjacent bucket rims toward each other. The upper rim of one bucket contacts the vertical wall 60 and the upper rim of the other bucket contacts the angled wall 86 and/or the outer vertical wall 88. The inverted channel of the support element 50 helps to keep the two buckets of a double bucket assembly together. The inverted channel is preferably non-perforated along the entire width of the support element so that any drops of fluid flow off the top of the support element 50 rather than through the structure.

Figure 5:
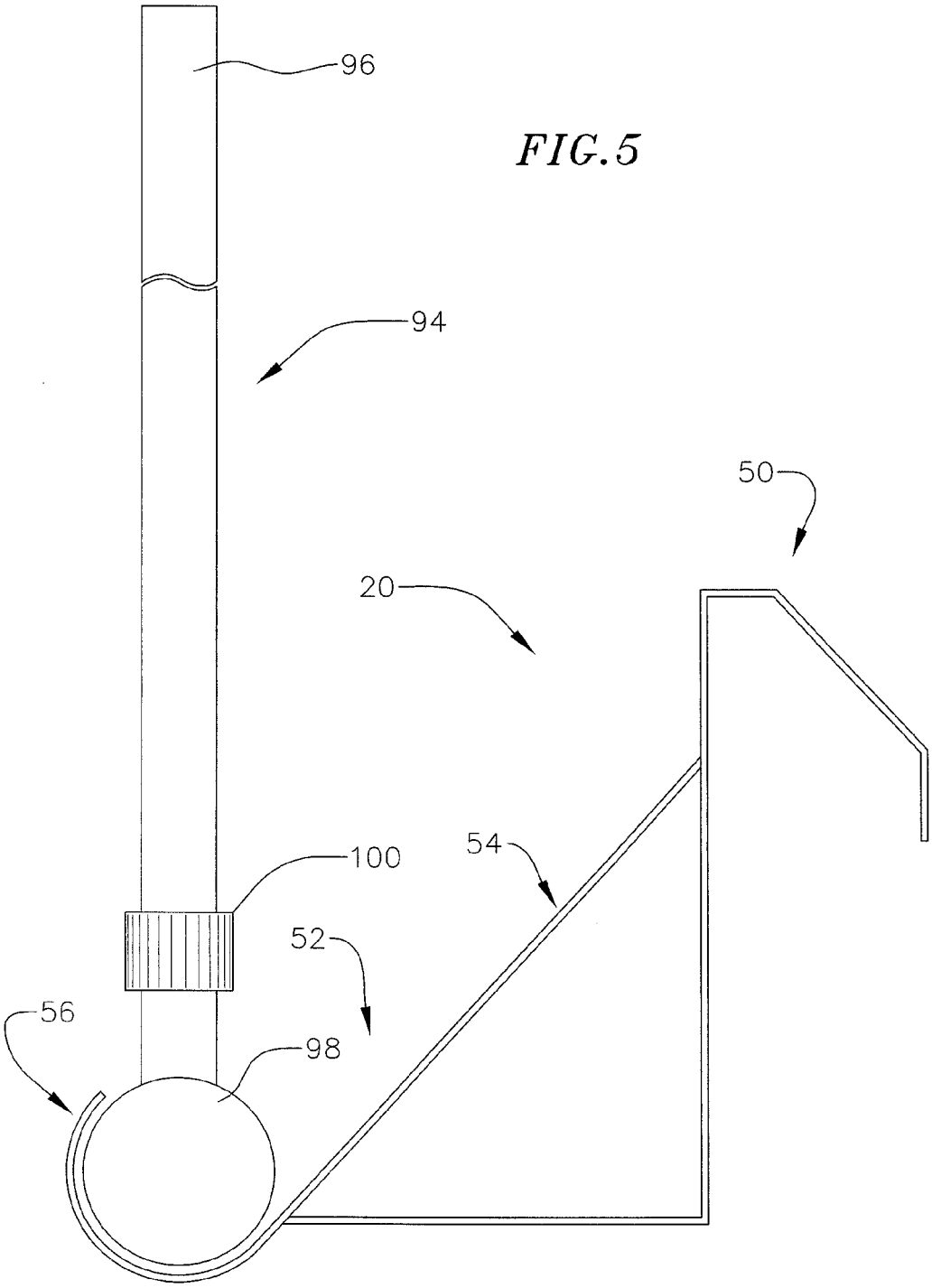
FIG. 5 is a side elevation view of the wringer of FIG. 2 and a round mop in position to be wrung.

As shown in FIG. 5, a round mop 94 includes a handle 96, a round mop head 98 for use on walls, for example, and a fastening element 100 for securing the mop head onto the handle. The mop head may take a number of configurations, including having foam, a cloth or other material covering, and the like. After the mop head is immersed in the fluid, the mop head 98 is pressed by the user into the perforated channel 56 of the wringer. Pressing the front, bottom and rear surfaces of the mop head against the curved walls of the channel 56 wrings some of the fluid from the mop head. The combination of the amount of pressure applied to the mop against the wringer channel and the number and configuration of the perforations help to determine the amount of fluid wrung from the mop head and the amount of fluid remaining in or on the mop head. In the configuration where the wringer is mounted to a bucket supported by rollers, castors or wheels, the angled base plate 54 and curvature of the perforated channel help to reduce the possibility of the bucket moving when the mop is being wrung.

Figure 6:
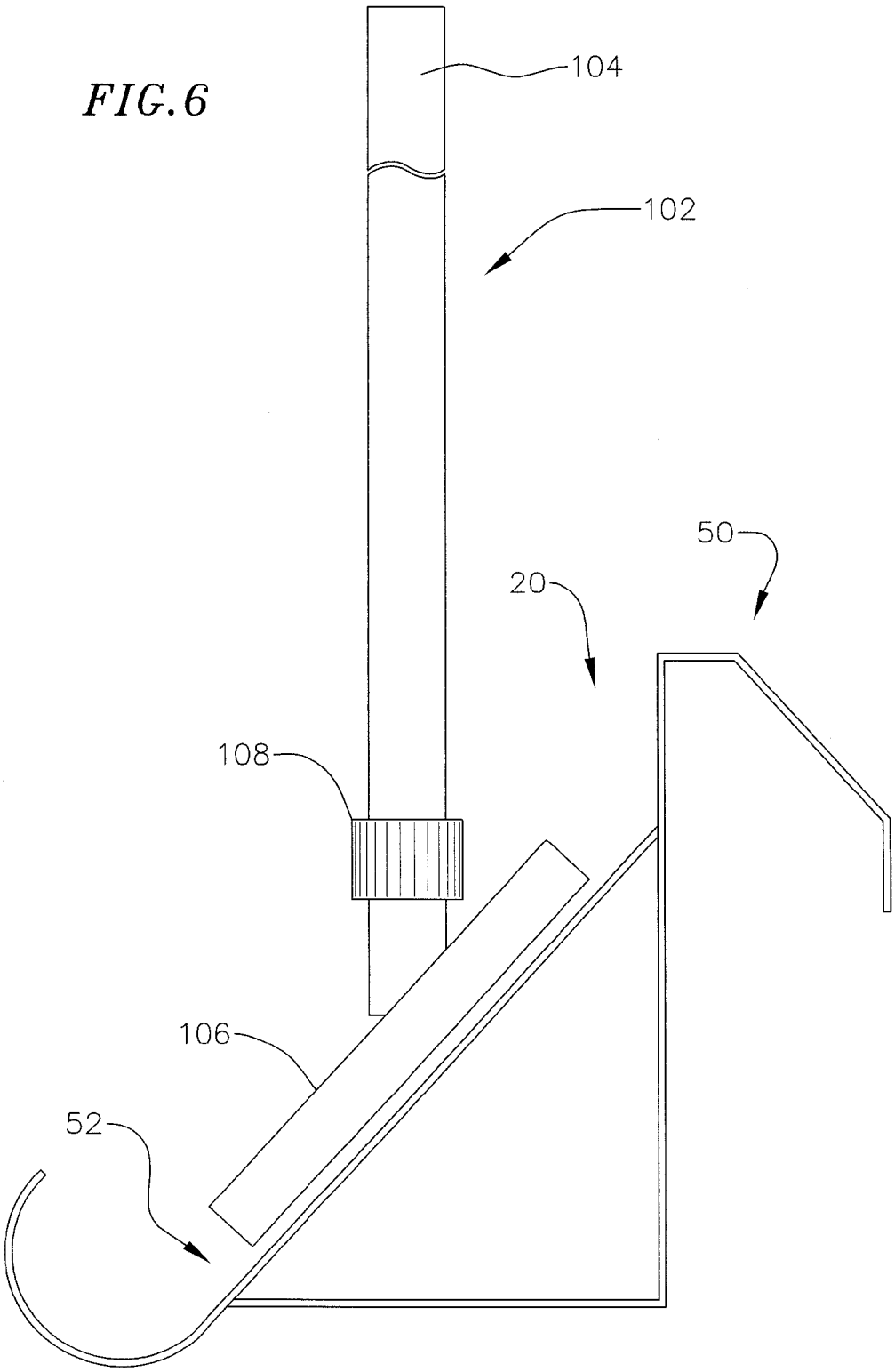
FIG. 6 is a side elevation view of the wringer of FIG. 2 and a flat mop in position to be wrung.

As shown in FIG. 6, a flat mop 102 includes a handle 104, a flat mop head 106 having a rectangular flat surface for use on floors and walls, for example, and a fastening element 108 for securing the mop head onto the handle. As with the round mop, the mop head may take a number of configurations, including having foam, cloth or other material. After the mop head is immersed in the fluid, the mop 102 is pressed by the user against the perforated base plate 54 of the wringer. Pressing the flat face of the flat mop head 106 against the perforated base plate 54 wrings some of the fluid from the mop head. Similarly, a combination of the amount of pressure applied to the mop against the wringer base plate and the number and the configuration of the perforations help to determine the amount of fluid wrung from the mop head and the amount of fluid remaining in or on the mop head. In the configuration where the wringer is mounted to a bucket supported by wheels, the angle of the base plate helps to reduce the possibility of the bucket moving when the mop is wrung. The sides of the flat mop head can also be pressed against the base plate.

The wringer is preferably configured so as to occupy less than half of the opening of a bucket, allowing ready access for the mop to the bottom of the bucket. It is formed by stamping and forming or by other methods from a suitable material, for example stainless steel, in a manner similar to other equipment used in cleanrooms, medical areas, and the like. Some exemplary dimensions for the wringer include the upper wall 64 extending horizontally front to back about ½ inch, the angled wall 86 extending downwardly approximately one inch, and the outer vertical wall 88 extending downward approximately half-inch. The vertical wall 60 extends downwardly approximately one inch. The perforated base plate extends downwardly from the junction 62 approximately four inches, and the perforated channel 56 has a radius of approximately one and ¼ inch. The ear flanges 82 and 84 preferably extend inwardly approximately ¼ inch. The vertical height of the ear flanges and the adjacent edges of the side plates is approximately two and ¾ of inch. Other dimensions can be used as well.

Having thus described several exemplary implementations of the invention, it will be apparent that various alterations and modifications can be made without departing from the inventions or the concepts discussed herein. Such operations and modifications, though not expressly described above, are nonetheless intended and implied to be within the spirit and scope of the inventions. Accordingly, the foregoing description is intended to be illustrative only.

What is claimed is:

1. A wringer comprising:

a support element for supporting the wringer from a support surface, the support element including a first support wall for supporting a wringer element on a first side of a container wall and a second support wall extending to a free end on a second side of a container wall and a third support wall positioned intermediate the first and second support walls and wherein the third support wall extends in a direction other than vertical and other than horizontal;

a wringer surface supported by the support element; and wherein the wringer surface includes a first portion that extends at a first angle in a first direction from a vertical line from the support element to a lower wringer surface below the support element and wherein the wringer surface includes a second portion extending away from the first portion in a second direction different from the first direction and terminates at a free end below the support element.

2. The wringer of claim 1 wherein the wringer surface depends from the first support wall of the support element.

3. The wringer of claim 1 wherein the first portion of the wringer surface is substantially flat.

4. The wringer of claim 1 wherein the second portion of the wringer surface is curved.

5. The wringer of claim 4 wherein the second portion of the wringer surface curved through an arc greater than 90 degrees.

6. The wringer of claim 1 wherein the wringer surface includes perforations that are substantially round.

7. The wringer of claim 1 wherein the first and second portions of the wringer surface include perforations.

8. The wringer of claim 1 wherein the first portion of the wringer surface extends at the first angle of approximately 45 degrees.

9. The wringer of claim 1 wherein the first support wall of the support element includes a first vertical wall and wherein first support wall and the first portion of the wringer surface join to form an angle of approximately 135 degrees.

10. The wringer of claim 9 wherein the second portion of the wringer surface curves from the first portion and terminates so as to be pointing in a direction toward the support element.

11. The wringer of claim 1 wherein the support element extends longitudinally and wherein the wringer surface extends longitudinally approximately the same distance as the support element and wherein the support element is substantially free of openings through the material of the support element.

12. The wringer of claim 1 wherein the support element includes an upper surface and the upper support surface and the third support wall extend away from the wringer surface.

13. The wringer of claim 12 wherein the third support wall extends at an angle of approximately 45 degrees from a vertical line.

14. The wringer of claim 12 wherein the third support wall terminates at the second support wall, wherein the second support wall is approximately vertical and has a free edge and wherein the free edge is positioned at a line below the upper surface of the support element lower than a junction line between the first wall of the support element and the wringer surface.

15. A wringer for a mop comprising:

a support having an upper support wall and first and second depending support walls extending away from the upper support wall and wherein the second depending support wall terminates at a free surface;

wherein the first depending support wall terminates at and joins a wringer surface along a line at least partly closer to the upper support wall than the free surface and wherein the first depending support wall and the wringer surface form an angle at the line, and having at least one wall defining an opening through the wringer surface, wherein the wringer surface includes a first portion that is substantially flat and a second portion that is curved and terminates at a free edge.

16. The wringer of claim 15 wherein the free edge of the second portion is at a lower vertical position than the line joining the wringer surface with the first depending support wall.

17. The wringer of claim 15 wherein the free edge of the second portion is at a lower vertical position than the free surface of the second depending support wall.

18. A wringer comprising:

a wringer having a support channel for engaging a rim surface of a bucket, wherein the support channel includes a support wall, the wringer further includes a first wringer surface supported by the support wall and a second wringer surface having perforations and supported by the first wringer surface wherein the second wringer surface is curved and terminates in a free edge below the rim surface of the bucket, and wherein the wringer further includes a bucket wall engagement element extending in a direction away from the first wringer surface toward a bucket surface when the wringer is supported on a bucket, and wherein the wall engagement element includes at least one laterally extending wall positioned on the wall engagement element opposite the first wringer surface so as to extend at least partly parallel to an adjacent surface of a bucket wall.

19. The wringer of claim 18 wherein the wall engagement element is a first wall engagement element positioned on the wringer at a first side portion of the wringer and further including a second wall engagement element at a second side portion of the wringer wherein the second wall engagement element includes a second laterally extending wall opposite the first wringer surface.

20. The wringer of claim 19 wherein the first and second wall engagement elements extend toward each other.

* * * * *